US005510051A

United States Patent [19]

Lam

[11] Patent Number: 5,510,051

[45] Date of Patent: Apr. 23, 1996

[54] PREPARATION OF A MULTI-PURPOSE CLEANER

[76] Inventor: Tony Lam, 2354 Beckwith St. #A, Honolulu, Hi. 96822

[21] Appl. No.: 283,811

[22] Filed: Aug. 1, 1994

[51] Int. Cl.[6] ..... C11D 3/06; C11D 7/16; C11D 11/00

[52] U.S. Cl. ..... 252/135; 252/173; 252/525; 252/DIG. 14

[58] Field of Search ..... 252/135, 173, 252/525, DIG. 14

[56] References Cited

U.S. PATENT DOCUMENTS 4,752,411 6/1988 Melin et al. ..... 252/174.16
4,921,629 5/1990 Malihi et al. ..... 252/170

*Primary Examiner*—Paul Lieberman
*Assistant Examiner*—Lorna M. Douyon
*Attorney, Agent, or Firm*—Michael I. Kroll

[57] ABSTRACT

A two-stage formulation for a general purpose industrial cleaner has been found to be ideal in terms of its effectiveness, ease of production and long term stability. The base compound formulation includes: (1) water, (2) tetrapotassium pyrophosphate (T.K.P.P.), (3) trisodium phosphate, (4) a premixed blend of tall oil fatty acid, nonionic surfactant, and monoethanolamine, (5) coconut diethanolamide, (6) glycol butyl ether, (7) isopropyl alcohol, and (8) 45% potassium hydroxide solution. A finished product is made from; (1) water, (2) base compound, (3) more T.K.P.P., (4) more glycol ether butyl, and (5) lemon fragrance. The two-part formulation allows for the concentrated base compound to be separately mixed and shipped with the diluted finished product to be formulated near the locality of the end user.

2 Claims, No Drawings

PREPARATION OF A MULTI-PURPOSE CLEANER

BACKGROUND OF THE INVENTION

1. Field of the Invention

The present invention relates to industrial strength surface cleaners. More specifically, it relates to a formulation and method for producing of a high strength general purpose industrial cleaner which is safe to use and yet unexcelled in its effectiveness. The two-stage formulation of the cleaner makes it possible to prepare the base in one location and mix the final product at numerous satellite locations. The fields of manufacturing as well as any field requiring heavy duty cleaning are potential benefactors of the invention.

Thus it can be seen that the potential fields of use for this invention are myriad, and the particular preferred embodiment described herein is in no way meant to be limiting the particular field chosen for exposition of the details of the invention.

2. Description of the Prior Art

The art of cleaning has existed since prehistoric times. The industrial age ushered in many diverse requirements for cleaning which were previously unknown. It became necessary to remove soil, grease, and other contaminants from the surfaces of parts prior to welding, painting, or assembling. The advent of plastics led to many other cleaning formulations because of the solubility of the plastic material. These diverse cleaning requirements emphasize the need for a good, general-purpose, non-toxic cleaner as proposed herein.

Numerous cleaning formulations have been provided in prior art that are adapted to provide industrial cleaning of various articles, but many are toxic in nature and cause long term harm to the environment. While these units may be suitable for the particular purpose to which they address, they would not be as suitable for the purposes of the present invention as described. The unique two-stage formulation of the instant invention is not suggested in any prior art known. There are other unique aspects, described more fully later, which serve to differentiate the instant invention from any known prior art.

As will be seen, the simplicity and effectiveness of my invention is not rivaled in the prior art.

SUMMARY OF THE INVENTION

Briefly, the invention comprises a formulation for a general purpose industrial cleaner which has been found to be ideal in terms of its effectiveness, ease of production and long term stability. The base compound formulation includes: (1) water, (2) tetrapotassium pyrophosphate (T.K.P.P.), (3) trisodium phosphate, (4) a premixed blend of tall oil fatty acid, nonionic surfactant, and monoethanolamine, (5) coconut diethanolamide, (6) glycol butyl ether, (7) isopropyl alcohol, and (8) 45% potassium hydroxide solution. A finished product is made from; (1) water, (2) base compound, (3) more T.K.P.P., (4) more glycol ether butyl, and (5) lemon fragrance. The two-part formulation allows for the concentrated base compound to be separately mixed and shipped with the diluted finished product to be formulated near the locality of the end user.

Accordingly, it is a principal object of the invention to provide a new and improved multi-purpose industrial cleaner which overcomes the disadvantages of the prior art in a simple but effective manner.

It is a major object of this invention to provide an industrial cleaner which may be mixed in a concentrated form at one location and diluted to form a finished product at another location.

It is another object of the invention to provide an industrial cleaner in which the aromatic portions are added in the finished product stage so as to minimize loss by evaporation from the base compound stage.

It is another object of the invention to provide an industrial cleaner which uses a pleasant fragrance so as to mask the caustic fumes which may be generated when the cleaner reacts with surface contaminants.

It is yet another object of the invention to provide a method of producing an industrial cleaner in which the container used for mixing the formulation is the same barrel that is used for the shipment of the product.

Finally, it is a general goal of the invention to provide improved elements and arrangements thereof in an apparatus for the purposes described which is inexpensive, dependable and fully effective in accomplishing its intended purposes.

It is submitted that the present invention meets or exceeds all the above objects and goals. Upon further study of the specification and appended claims, further objects and advantages of this invention will become apparent to those skilled in the art.

These and other objects of the present invention will become readily apparent upon further review of the following specification.

DETAILED DESCRIPTION OF THE PREFERRED EMBODIMENT

The industrial cleaner of the instant invention will be described in terms of the approximate quantities of materials used to formulate 55 gallons of the base compound. Using 11 gallons of the base compound, the approximate quantities of additional materials used to formulate 55 gallons of the finished product will be described. In other words a barrel of base compound can be used to create 5 barrels of finished product. Since the finished product mixing requires no special equipment, it is anticipated that the finished product could be mixed at a different locality from the base compound. It is obvious that significantly reduced shipping and distribution charges will be incurred by using this two-stage production method. Other benefits also accrue as will be mentioned later.

It is to be understood that the quantities of materials mentioned in the following description are not exact and that a relatively large variation is possible without destroying the efficacy of the product. Also, any quantity mentioned may be adjusted upward or downward proportionally so as to produce the product in any desired amount.

Necessary apparatus for making this industrial cleaner formulation are all conventional and simple. A conventional metal 55 gallon drum may be used as both the primary container for production of the cleaner as well as the container used for the shipment of the cleaner. Also needed will be a conventional portable mixing unit suitable for immersing into the 55 gallon drum from the top for the purpose of providing agitation to the ingredients as they are serially added to the drum in the filling and producing process. Of course the appropriate pouring spouts, chemical handling containers, etc., will be needed but form no part of the instant invention and are not further described here.

The process of making the base compound will be described first. A 55 gallon drum is filled half full of tap water and a conventional submersible mixer is started to provide turbulence. There is no need to use distilled or pure water as one of the ingredients to be added is an efficient water softener. Next 15 pounds of T.K.P.P. (tetrapotassium pyrophosphate) and 15 pounds of T.S.P. (trisodium phosphate) is added to the turbulent water in the drum. Trisodium phosphate is a water softener. A water softener is a substance that renders inactive or isolates minerals, such as calcium, magnesium, iron, or manganese in hard water. Mineral salts in hard water precipitate the fatty acids in soap in the form of scum or gelatinous curd. This effect is neutralized effectively by the T.S.P.

The next three items are blended together in a separate container;

(1) two gallons of a tall oil fatty acid such as commercially available "Pamak-4", (2) one and one-half gallons of solution containing ten moles of a nonionic surfactant such as octylphenol or nonylphenol, commercially available as "Tergitol", and (3) one and one-quarter gallons of monoethanolamine.

The above fatty acid blend is then added to the mix of water, TSPP, and TSP in the 55 gallon drum.

One and one-half gallons of coconut diethanolamide, commercially available as "Calimide C" is then added to the mixture.

One and one-half gallons of glycol ether butyl is then added to the mixture.

Two gallons of isopropyl alcohol are then added. Isopropyl alcohol is commonly used as an antiseptic and is widely available and easily obtainable.

The final and primary active ingredient added to the base mixture is two and one-half gallons of 45% solution potassium hydroxide. Potassium hydroxide is a strongly basic alkali. It is also called caustic potash and is commonly used as commercial drain or oven cleaner. The chemical is commonly used in making soft soap. The caustic nature of this ingredient make it imperative that extreme care be taken to prevent worker contact prior to its dilution with the water and other ingredients in the drum.

The 55 gallon drum is then topped off with water and mixed until consistency throughout is achieved. The barrel of base compound is then ready to be capped and shipped or stored.

The process of making the finished product from the previously prepared base compound will now be described. As before, an empty 55 gallon drum will be the starting point. First the drum will be filled two-thirds full of water and an immersible mixer is again inserted and started to provide turbulence.

First, 15 pounds of TKPP are added to the water. Eleven gallons of base compound as prepared above are then added to the turbulent mixture. Essentially this mixture becomes the starting point for the finished product.

The artisan will recognize that this batch of finished compound will contain 18 total pounds of TKPP (3 pounds from the ⅕ portion of the base compound plus the present 15 pounds).

Now, four gallons of glycol ether butyl is added. The artisan will note that the majority of this volatile ingredient is being added at the finished product stage rather than at the base compound stage. One reason for this is to cut down on the volatility and evaporative losses in the base compound which may be stored for an appreciable period of time. It is anticipated that the finished product, on the other hand, will be mixed a short period of time before delivery to the final user, or perhaps even mixed personally by the final user.

The final ingredient added to the finished product is a fragrance. Approximately 1 liter, or about a quart, of fragrance has been found to be suitable for a 55 gallon drum of finished product. Although any fragrance may be used, a lemon fragrance is preferred. The acetic lemon odor does well at concealing the pungent basic odor of the potassium hydroxide. Also, many users associate the smell of lemon with cleanliness.

The final step in the preparation of the finished product is to top off the 55 gallon drum with water and again to mix until consistency is achieved.

The above mixing of ingredients may all be done at normal room temperatures although it is contemplated that a cooler temperature might be more ideal so as to reduce evaporative losses of the volatile ingredients. Of course the temperature must be above the freezing point of water during the mixing of the product. The finished product, however, will have a freezing point somewhat below that of pure water.

The artisan will note that 5 barrels of finished product can be made from 1 barrel of base compound. Therefore significant savings in storage, distribution, and shipping costs will be achieved by the two-stage formulation method of this invention.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily vary the quantities by as much as 20% and still achieve substantially the same cleaner. The following claims are intended to cover the range of such obvious variations.

It is to be understood that the present invention is not limited to the sole embodiment described above, but encompasses any and all embodiments within the scope of the following claims:

I claim:

1. A method of producing an industrial cleaner in a first stage for storage or shipment and a second stage for use, the first stage comprising the steps of;

filling a first 55 volume unit drum half full of water;

inserting and starting a mixer in said drum;

adding 15 weight units of tetrapotassium pyrophosphate;

adding 15 weight units of trisodium phosphate;

blending in a separate container a blend containing, 2.0 volume units of tall oil fatty acid, 1.5 volume units of a solution of phenol containing 10 moles selected from the group consisting of octylphenol and nonylphenol, and 1.25 volume units of monoethanolamine;

adding said blend to said first drum;

adding 1.5 volume units of coconut diethanolamide;

adding 1.5 volume units of glycol butyl ether;

adding 2.0 volume units of isopropyl alcohol;

adding 2.5 volume units of 45% solution of potassium hydroxide;

filling said first drum with water; and mixing until consistency is obtained so as to create 55 volume units of base compound in said first drum;

storing or shipping said first drum containing base compound for use; and diluting said base compound for use in a second stage comprising the steps of;

filling a second 55 volume unit drum ⅔ full of water;

inserting and starting a mixer in said second drum;

adding 11 volume units of said base compound;

adding 15 weight units of tetrapotassium pyrophosphate;

adding 4.0 volume units of glycol butyl ether;

adding sufficient lemon fragrance to give a pleasant odor;

filling said second drum with water; and mixing until consistency is obtained so as to create 55 volume units of finished product said volume units being gallons and said weight units being pounds ready for use.

2. The method of claim 1, further comprising;

repeating the steps of the second stage four more times so as to create a total of five 55 gallon barrels of finished product from one 55 gallon barrel of said base compound.

* * * * *